United States Patent [19]

Fester et al.

[11] 4,446,206

[45] May 1, 1984

[54] SET POLYACRYLONITRILE FILAMENTS AND FIBERS, AND A PROCESS FOR THEIR PRODUCTION

[75] Inventors: Walter Fester, Königstein; Bernd Huber, Wiesbaden, both of Fed. Rep. of Germany

[73] Assignee: Hoechst Aktiengesellschaft, Frankfurt am Main, Fed. Rep. of Germany

[21] Appl. No.: 359,233

[22] Filed: Mar. 18, 1982

[30] Foreign Application Priority Data

Mar. 20, 1981 [CH] Switzerland ..... 1918/81

[51] Int. Cl.[3] ..... D02G 3/00; D01D 5/12

[52] U.S. Cl. ..... 428/364; 264/210.7

[58] Field of Search ..... 428/364; 264/210.7, 264/210.8, 182

[56] References Cited

U.S. PATENT DOCUMENTS 3,814,739 6/1974 Takeda ..... 264/210.7
3,984,601 10/1976 Blickenstaff ..... 428/364
4,140,844 2/1976 Lohwasser ..... 428/364
4,331,732 5/1982 Palethorpe ..... 428/364

FOREIGN PATENT DOCUMENTS 47-39722 12/1972 Japan ..... 264/182

*Primary Examiner*—George F. Lesmes
*Assistant Examiner*—Beverly K. Johnson
*Attorney, Agent, or Firm*—Curtis, Morris & Safford

[57] ABSTRACT

The invention relates to filaments and fibers spun from at least 98% by weight of polyacrylonitrile and relative viscosities of between 2.5 and 6.0 which have tensile strengths of more than 50 cN/tex with an elongation at break of at most 15% and a shrinkage at the boil of less than 5% and to a process for their production which comprises at least 2 stretching stages with a minimum stretching ratio of 1:9 as well as a concluding setting stage in which the filaments are treated without shrinkage in dry heat at 170° to 280° C.

Such filaments and fibers are distinguished by an increased resistance to swelling and hydrolysis and they are particularly suitable for reinforcing organic and inorganic materials.

1 Claim, No Drawings

SET POLYACRYLONITRILE FILAMENTS AND FIBERS, AND A PROCESS FOR THEIR PRODUCTION

The invention relates to filaments and fibers of polyacrylonitrile, the filament-forming substance of which is composed to at least 98% by weight of acrylonitrile units and has a high average molecular weight. Filaments and fibers can be obtained by a special stretching and setting process, which have an increased resistance to swelling and hydrolysis processes even at elevated temperatures.

It is known to subject polyacrylonitrile filament tow to multi-stage stretching in order to obtain filaments or fibers which, owing to their initial modulus values, are supposedly particularly suitable for industrial applications. Thus, for example, German Offenlegungsschrift No. 2,851,273 describes a process in which the filaments, direct after a wet-stretch, are further stretched in a "steam pressure stretching zone" at temperatures of 110° to 140° C. and under the influence of saturated steam under pressure. A similar stretching process at elevated temperatures and under steam pressure is also described in German Democratic Republic Pat. No. 135,509. When certain conditions were maintained it was even possible to achieve initial moduli of up to about 1,200 cN/tex. For example, it was necessary to spin particularly fine deniers or to employ an especially prepared solution polymer.

It has also already been proposed to replace the industrially very expensive steam stretch under pressure by a dry contact stretch, in which even still higher initial modulus values can be obtained. Filaments and fibers of this type can be used highly successfully in industrial applications, for example for the production of filters and filter fabrics, as base fabric in the production of coated fabric and, in particular, also for the reinforcement of organic and inorganic materials.

However, it was found, particularly in the production of such fiber-reinforced composites, that the filaments or fibers used for reinforcement no longer have optimum properties when temperatures of about 100° C. in an anhydrous medium and temperatures of about 80° C. in an aqueous medium are exceeded in the production of the composites. It must be assumed that under these conditions structural changes occur in the fibers which make them more vulnerable to attack by the solvent present in the setting composite, monomers and other primarily low-molecular constituents, or make them more vulnerable to a hydrolytic attack in the presence of water during the production of fiber-reinforced composites. For example, such a vulnerability can be observed when the fiber-reinforced composites have hydraulically setting binders, ie. the aqueous phase has an alkaline reaction. It is assumed that the influence of solvent residues and monomers in particular leads to an incipient swelling at elevated temperatures and that the reinforcing properties of the filaments, ie. in particular their initial modulus and the fiber tensile strength, are likewise reduced by it.

There was, therefore, still the object of developing polyacrylonitrile fibers particularly suitable for industrial applications, which retain their good physical properties even above 100° C. in an anhydrous medium or above 80° C. in water-containing media.

It has now been found, surprisingly, that such filaments and fibers can be obtained when their filament-forming substance is composed to at least 98% by weight of acrylonitrile units and has a relative viscosity, measured on a 0.5% strength solution in dimethylformamide at 25° C., in a range between 2.5 and 6.0, the filaments are wet-stretched before or after the wash, dried under tension on hot rolls and after-stretched under the influence of dry heat at 140° to 200° C., the after-stretch ratio being at least 1:1.5 and the total stretch ratio being preferably at least 1:9, and after this after-stretch the filaments are set by the action of dry heat at 170° to 280° C. with shrink prevention.

The necessity for a setting treatment is surprising since it is generally known that in such a setting treatment the fiber tensile strength and the initial modulus decrease and extensibility values increase. It is also known that such a setting treatment normally facilitates the diffusion of low-molecular compounds into the fiber interior. For example, it is known that set fibers take up dyestuffs at a considerably higher rate than the corresponding unset filaments or fibers. However, if filaments and fibers, the filament-forming substance of which has the required composition and a high relative viscosity, are stretched and set by the process according to the invention, they have better reinforcing effects, if these composites are exposed to high temperatures for several hours during the production, than comparable unset fibers, even when the initial modulus of the latter is higher.

It was possible to observe the higher reinforcing effects not only in the case of organic composite systems, for example based on epoxide resins or unsaturated polyester resins, but also for inorganic systems having hydraulic binders.

To characterize this novel property of the filaments and fibers according to the invention the change of the physical properties in a Portland cement filtrate at elevated temperatures and for an exposure time of several hours was chosen. Such a filtrate has a number of advantages which cannot be obtained in a test with organic substances. The action of the Portland cement filtrate produces a slight swelling and a hydrolytic attack on the fibers. The fibers under test can be separated from the filtrate in a simple manner, while their extraction from hardening organically based compositions can give rise to considerable errors. The use of pure monomer mixtures, prevented from polymerizing, for example, by the addition of inhibitors, leads to concentration and diffusion conditions which do not agree with those prevailing in practice.

To produce filaments and fibers according to the invention the following conditions must be satisfied:

1. The filament-forming substance must be composed to at least 98, preferably 99, % by weight of acrylonitrile elements.

2. The relative viscosity of the filament-forming substance must be between 2.5 and 6.0, preferably between 2.6 and 3.5.

3. The total stretch ratio of filaments taken off the jet must be at least 1:9, the stretch being divided into a wet-stretch in hot baths and an after-stretch after drying, and the after-stretch under dry heat having to be carried out with a stretch ratio of at least 1:1.5

4. After the final stretch under dry heat the filaments must be set with shrink prevention by the application of dry heat. The temperatures required here are within the range of 170° to 280°, preferably 180° to 250° C.

These conditions produce filaments and fibers which are distinguished by high tensile strengths of 50 to 100 cN/tex, preferably 55 to 80 cN/tex, by a low boil shrinkage of less than 5%, preferably less than 3%, and by elongations at break of at most 15, preferably at most 12%. The resulting fibers and filaments in addition also have excellent resistance to the action of media having a swelling and hydrolytic effect. After 24 hours' treatment in a hot, aqueous, alkali medium at 90° C., prepared by extraction of 150 g of Portland cement with 1 l of water, and subsequent washing and drying, the fibers still have an initial modulus of at least 900 cN/tex, preferably of at least 1000 cN/tex, relative to an elongation of 100%. Filaments and fibers thus tested shrink by less than 5% in this hot, wet, alkali treatment.

Fibers which shrink by no more than 1% under these hot, wet, alkali conditions have the best reinforcing properties. This is also a surprising result since up to now it has been assumed that at least a part of the reinforcing effects observed in composites was based on the fact that the fibers employed in the setting or polymerization process should preferably have a relatively high shrinkage which leads to a kind of pre-stressing of the composite and hence to an improved strengthening.

Filaments and fibers according to the invention are particularly suitable as reinforcement filaments or fibers, or in the form of woven fabrics, knitted fabrics or nonwovens, in the production of reinforced organic or inorganic materials. These products are particularly advantageous for the production of products having a fine pore structure and containing hydraulic binders. However, they are also suitable for the production of filters or filter fabrics or as base fabric in the production of coated fabrics.

The invention also relates to the process for the production of fibers and filaments by a wet or dry spinning method, in which process the spun filaments are wet-stretched before, during or after a wash treatment, the filaments are then dried and then subjected to a hot-stretch. The process according to the invention comprises drying the filaments, which may be in the form of a tow or a bundle, under tension on hot rolls and then subjecting them to contact-stretching with a stretch ratio of at least 1:1.5, the effective total stretch ratio having to be at least 1:9. Contact-stretching is here to be understood as meaning the stretching in a dry, hot state, for example with the use of bodies with heated surfaces.

After the contact-stretch the filaments are set by the action of dry heat. This can be effected, for example, on revolving hot rolls, on irons, in a hot-air duct or by infrared radiation.

Possible polymeric raw materials are precipitation or solution polymers prepared by customary processes. Depending on the application requirements not only homopolymers but also copolymers of acrylonitrile can be used. The monomers employed should have as high a purity as possible. Suitable comonomers are any unsaturated compounds which can be copolymerized with acrylonitrile.

Those polymers can be employed, the relative solution viscosities of which—measured in 0.5% strength dimethylformamide solutions—are within a range from 2.5 to 6.0. Polymers which are within a viscosity range from about 2.6 to 3.5 afford particularly good results under commercial conditions.

The polymers employed should preferably have a content of at least about 99% by weight of acrylonitrile units.

In the preparation of spinning solutions the dissolving conditions must be so chosen that spinning solutions are obtained which are free of gel particles and are as homogeneous as possible. To check the quality of a spinning solution scattered-light measurements using a laser as a light source are particularly suitable. Only blemish-free spinning solutions having very low scattered-light values make possible the high stretching ratios required according to the invention. The spinning solutions can be prepared not only continuously but also discontinuously. Inorganic or organic additives can be incorporated into the spinning solution, such as, for example, delustering agents, stabilizers, flameproofing additives or the like.

The spinning process according to the invention is distinguished by a high effective total stretch ratio of at least 1:9. In determining the effective total stretch only the wet-stretch and the contact-stretch are taken into account, while filament shrinkage is subtracted. The so-called jet-stretch is not considered when working out total stretch values, freshly spun filaments, which are obtained after a dry or wet spinning process, being on the contrary counted as unstretched material. The effective total stretch ratio in the process according to the invention should be at least 1:9. Effective total stretch ratios of 1:10 to 1:25 are preferred.

The process according to the invention can be carried out on conventional filament or fiber spinning plants. New, hitherto not customary techniques are not required. It is in particular not necessary to employ a special stretching chamber in which the filaments, for example in the form of a tow, are exposed to the action of steam under pressure. The process is distinguished by high total stretch values of freshly spun filaments, an effective minimum stretch of at least 900% being required. This effective total stretch is carried out in several steps. First the filaments, before or after the residual solvent content has been washed out, are wet-stretched in one hot bath or stepwise in several hot baths. The temperature of the stretching bath media which as a rule comprise mixtures of water and the solvent, should be maintained at as high a value as possible. The temperatures are preferably just below the boiling point of the bath liquid. It is also possible however to use baths which contain other stretching bath media, for example glycol or glycerol, if appropriate in a mixture with the polymer solvent, in which stretching temperatures can also be selected which are above 100° C. After the stretch and the washing-out of the residual solvent content, it being also possible first to wash out and then to stretch, the filaments are finished in a finishing bath and then freed as substantially as possible from adhering water in a customary manner by the action of revolving pairs of press rolls. The finish applied in the finishing bath can affect the stretching behaviour of the filaments. That finish mixture should therefore be selected from among the known finish mixtures which has a low fiber-fiber friction.

The filaments are then dried under tension on hot rolls. A small amount of shrinkage, which frequently proves advantageous in the subsequent stretching, can be permitted during the drying; however, in adjusting the shrinkage care must be taken that the tow is always under tension when running over the drying rolls. The temperature of the rolls should be so chosen that the tow leaves the dryer with a very low residual moisture content which ideally is less than 1%. Temperatures within a range from 140° to 200° C. have proved particularly advantageous for these rolls, but this does not exclude the use of higher or lower temperatures. Likewise, drying can be carried out on these rolls with stepped temperatures.

After drying, the spun tow is stretched again, with the application of dry heat, to at least 1.5 times its length. This stretching can likewise be carried out in one or several steps. The tow can be heated by the methods customary in industry, for example by circulating around hot rolls, by contact with hot plates, in a hot-air duct or even by radiation, in particular by infrared radiation. It is also possible to use a stepwise stretch in which various heating methods are used.

The stretch temperatures depend on the type of polymer used and partially on the preceding stretch and on the drying conditions. In general, a temperature range of about 120° to 250° C., is suitable, with a range from 140° to 200° C. being particularly advantageous.

After the stretch the filaments are set with shrink prevention by the action of dry heat at temperatures of 170° to 280° preferably 180° to 250° C. The setting can be carried out by the methods customary in industry, for example by circulating around hot rolls, by contact with hot plates, in a hot-air duct or even by radiation, in particular by infrared radiation.

After the setting the filaments are cooled and, by means of known methods, either wound up to give continuous filament material or cut into the length desired to give stable fibers. If the intended use makes it necessary a special finish can be applied to the filaments or fibers before or after the cutting.

The choice of temperatures and of the residence time of the filaments in the setting stage can have a marked influence on the obtainable physical properties of the filaments thus treated and on their resistance to materials having a swelling and/or hydrolytic effect. However, the optimum conditions for each particular case can be determined by simple experiments. The conditions are influenced, for example, by the denier of single filaments, the total denier of the tow, the degree of contact with the heated surfaces, and so on. Under the conditions of Example 4, optimum values were observed at temperatures for the 1st duo of 190° C. and 230° to 250° C. for the 2nd duo as well as total residence times at the surfaces of the rolls of about 40 seconds.

The examples which follow are intended to illustrate the invention. Unless otherwise indicated, percentage data and parts are units by weight.

EXAMPLE 1

A polymer composed of 99.4% of acrylonitrile and 0.6% of methyl acrylate was continuously dissolved in dimethylformamide to give a 17% strength spinning solution, which was filtered and degassed. This spinning solution was forced at a rate of 351 g/minute through a 2,500 hole jet, hole diameter 0.06 mm, into a warm coagulation bath at 50° C. which contained 56% of dimethylformamide (DMF) and 44% of water. The resulting filaments were drawn from the jet with a speed of 6.5 m/minute, stretched to six times their length in baths at 98° C. which contained 56% of DMF and 44% of water, and then washed. A shrinkage of 9% was permitted in the hot water wash. After passing through a finishing bath the filaments were dried at 165° C. and stretched at 180° C. in several steps to 2.4 times their length. The total stretch ratio was thus 1:13.1.

Single filaments thus produced had the following properties:

Denier: 2.8 dtex
Tensile strength: 81 cN/tex
Elongation to break: 8%
Initial modulus: 1,544 cN/tex
Shrinkage at the boil: 11%

After the second stretch filaments having these properties were set, with their length kept at a constant value, by passing over hot plates having a surface temperature of 230° C. After the setting single filaments had the following properties:

Denier: 2.8 dtex
Tensile strength: 71 cN/tex
Elongation at break: 10%
Initial modulus: 1,390 cN/tex
Shrinkage at the boil: 2.0%

The set fibers, and for purposes of comparison also unset fibers, were each treated for 24 hours at various temperatures with a cement filtrate prepared from 150 g of Portland cement and 1 l of water. The aqueous cement extract had a pH value of about 11.6. The filaments tested were briefly rinsed with water after their treatment and dried in air at room temperature. Stress-strain diagrams were then recorded for single filaments at a strain velocity of 100%/minute, and the initial moduli were determined.

| Treatment temperature °C. | Initial modulus (cN/tex) | |
|---|---|---|
| | Set fiber | Unset fiber (for comparison) |
| no treatment | 1,390 | 1,544 |
| 20 | 1,390 | 1,540 |
| 40 | 1,385 | 1,250 |
| 70 | 1,265 | 1,110 |
| 90 | 1,225 | 800 |

During the treatment at 90° C. the set fibers shrank by 3% and the unset fibers by 12.5%.

EXAMPLE 2

Analogously to Example 1 fibers having a single fiber denier of 1.3 dtex were spun. To do this the total stretch ratio had to be reduced to 1:12.3. The resulting fibers were set at 230° C. The following fiber data were obtained:

| | Set | Unset |
|---|---|---|
| Denier (dtex) | 1.3 | 1.3 |
| Tensile strength cN/tex | 70 | 78 |
| Elongation at break % | 10 | 8 |
| Initial modulus cN/tex | 1,370 | 1,490 |
| Initial modulus after 24 hours' treatment in a Portland cement filtrate at 90° C. cN/tex | 1,170 | 710 |

EXAMPLE 3 (for comparison)

As in Example 1 a polymer was spun into fiber but here the polymer was composed of 95% of acrylonitrile and 5% of methyl acrylate. For these filaments the stretch after drying had to be somewhat reduced, so that a total stretch ratio of only 1:11.7 resulted. The unset fibers had an initial modulus of 1,340 cN/tex, and those set at 230° C. had an initial modulus of 1,020 cN/tex. After a treatment for 24 hours at 90° C. in the Portland cement filtrate described the unset fiber had an initial modulus of 720 cN/tex and the set fiber had an initial modulus of 740 cN/tex. After this treatment the two fibers had in the moist state a slightly tacky surface, which is presumably due to the fact that the hot, alkaline medium had already incipiently hydrolyzed the fibers.

EXAMPLE 4

1,700 g of a polymer composed of 99.2% of acrylonitrile and 0.8% of methyl acrylate were discontinuously dissolved in 8,300 g of DMF. After it had been filtered and degassed this spinning solution was forced at a rate of 15.1 g/minute through a 100 hole jet, hole diameter 0.075 mm, into a coagulation bath at 50° C. which was composed of 50% of DMF and 50% of water. The resulting filaments were drawn from the coagulation bath at a speed of 5.5 m/minute and stretched, in a stretching bath at 99° C. composed of 60% of DMF and 40% of water, by raising the speed to 29.3 m/minute. The filaments were then washed, finished and dried on 2 duos having surface temperatures of 140° and 185° C. with a shrinkage which lowered the speed by 0.6 m/minute being permitted. The filaments were drawn from the 2nd duo at a speed of 33.3 m/minute and stretched over 4 hot plates at temperatures of 150°, 160°, 160° and 175° C., by raising the speed to 91.9 m/minute. The total stretch ratio was thus 1:16.5.

These filaments were then set with shrink prevention on 2 heated duos. The diameter of the duos was in each case 180 mm and the filaments were passed 42 times round the 1st duo and 39 times round the 2nd duo. The single filament properties of these resulting filaments before and after a treatment for 24 hours in a hot aqueous cement filtrate at 90° are shown in the table which follows as a function of the setting temperatures used. The denier of the filaments was in each case 2.8 dtex.

| Setting temperatures | | Fiber properties | | | Fiber properties after 24 hours' treatment with cement filtrate at 90° C. | | | |
|---|---|---|---|---|---|---|---|---|
| Duo 1 °C. | Duo 2 °C. | Tensile strength cN/tex | Elongation at break % | Initial modulus cN/tex | Tensile strength cN/tex | Elongation at break % | Initial modulus cN/tex | Shrinkage during the treatment % |
| 190 | 190 | 79 | 10 | 1,321 | 75 | 12 | 1,036 | 2 |
| 190 | 210 | 80 | 10 | 1,411 | 75 | 12 | 1,054 | 1 |
| 190 | 230 | 82 | 10 | 1,482 | 82 | 12 | 1,160 | 1 |
| 190 | 250 | 82 | 11 | 1,446 | 80 | 12 | 1,143 | 0.5 |
| 220 | 250 | 80 | 12 | 1,286 | 68 | 11 | 1,018 | 0 |

We claim:

1. A filament or fiber of acrylonitrile polymers, comprising a filament-forming substance which is composed to at least 98% by weight of acrylonitrile units and the relative viscosity of which is within a range between 2.5 and 6.0, and having a tensile strength of more than 50 cN/tex, a shrinkage at the boil of less than 5%, an elongation at break of at most 15% and an initial modulus greater than 900 cN/tex after an aqueous alkaline treatment at 90° C. for 24 hours.

* * * * *